US007107712B2

(12) United States Patent
Mueller

(10) Patent No.: US 7,107,712 B2
(45) Date of Patent: Sep. 19, 2006

(54) LIGHTING SYSTEM

(76) Inventor: Christine Ann Mueller, 1052 W. Jackson, Painesville, OH (US) 44077

( * ) Notice: Subject to any disclaimer, the term of this patent is extended or adjusted under 35 U.S.C. 154(b) by 1004 days.

(21) Appl. No.: 09/837,932

(22) Filed: Apr. 19, 2001

(65) Prior Publication Data

US 2002/0133993 A1 Sep. 26, 2002

Related U.S. Application Data

(63) Continuation-in-part of application No. 09/588,249, filed on Jun. 6, 2000, now abandoned.

(51) Int. Cl.
*G09F 13/18* (2006.01)

(52) U.S. Cl. ..... 40/546; 40/714; 40/737

(58) Field of Classification Search ..... 40/546, 40/547, 714, 737, 798; 362/31
See application file for complete search history.

(56) References Cited

U.S. PATENT DOCUMENTS 2,727,327 A * 12/1955 Colby ..... 40/714 X
4,918,578 A * 4/1990 Thompson ..... 40/547 X
4,922,384 A * 5/1990 Torrence ..... 40/547 X
4,995,181 A * 2/1991 Wolf ..... 40/714
5,027,258 A * 6/1991 Schöniger et al. ..... 362/31
5,265,357 A * 11/1993 Yu ..... 362/31 X
5,657,563 A * 8/1997 Lane ..... 40/714 X
5,695,346 A 12/1997 Sekiguchi et al.
5,894,686 A 4/1999 Parker et al.
5,923,020 A 7/1999 Kurokawa et al.
6,030,089 A 2/2000 Parker et al.
6,031,343 A 2/2000 Recknagel et al.
6,185,883 B1 * 2/2001 Howard ..... 40/546 X

* cited by examiner

*Primary Examiner*—Joanne Silbermann
(74) *Attorney, Agent, or Firm*—Forrest L. Collins Law Offices, LLC; Forrest L. Collins

(57) ABSTRACT

The invention described herein permits decorative or other lighting of a transparent or a translucent surface by placing a light source within a frame and contacting the light source with the transparent or translucent surface. The transparent or translucent surface may be eroded in one or more places to provide contrasting images on the transparent or translucent surface.

9 Claims, 3 Drawing Sheets

LIGHTING SYSTEM

The present application Ser. No. 09/837,932 filed Apr. 19, 2001 is a continuation-in-part of Ser. No. 09/588,249 filed Jun. 6, 2000 now abandoned.

BACKGROUND OF THE INVENTION

1. Field of the Invention

The present invention relates to decorative or other lighting of transparent or translucent surfaces by placing a light source within a frame.

2. Description of the Art Practices

U.S. Pat. No. 5,695,346 Sekiguchi et al., issued Dec. 7, 1997 describes an efficient economical process is provided to produce an impressive display with outstanding marketing and advertising appeal. In the process, multiple images are formed, such as on a central processing unit, the images are striped or manipulated, eliminating rows of pixels and replacing them with pixels from other images, and portions thereof are superimposed. The superimposed images can be printed on a viewable surface of the display. A lenticular lens, fresnel lenticular lens plate, lens with a textured surface, plate lens, ultraviolet cured resinous lens, lens with an undercut, cluster of anamorphic lenses, transparent rods, or grid, can be placed in front of the images to provide a special display which has the illusion of animation, morphing or movement as the angle of sight changes. The images can also be printed directly on the back surface of the lens to provide self-contained lenticular graphics. The special display can be used to provide: an attractive calendar, post card, decoding card, business card, bookmark, computer disc case, compact disc case, laser disc case, video cassette case, audio cassette case, display box, bag, insulating cup, lid, book, mural, picture frame, game piece, jewelry, button, shoe ornament, multi-faced hanging display, premium, award display, self-standing plaque, shelf header slide-in display, bumper sticker, pen, credit card, swinging display, wag, place mat, traffic sign, compact disc, laser disc, recordable disc, monitor, television screen, computer screen, flat screen panel display, and display with multiple rotating panels, as well as other products.

U.S. Pat. No. 5,894,686 Parker et al., issued Apr. 29, 1999 contains a disclosure of light distribution systems include a light emitting portion, a light source for supplying light to the light emitting portion and a power source for the light source. A sealed holder or pocket may be provided for the light emitting portion. The light emitting portion may be located on an upper portion of a shoe and include a raised or relieved area from which light is emitted. The light distribution systems may include an additional light source which is directional so it can be seen at a greater distance than the light emitting portion. An information display system may also be provided, including a liquid crystal display located on an upper portion of a shoe, and a motion sensor for controlling operation of the display.

U.S. Pat. No. 5,923,020 Kurokawa et al., issued Jul. 13, 1999 contains a description of a lighting apparatus 1 has a convex lens 11 arranged so that its optical axis is at an angle theta with respect to the normal of an observation portion 3*a* (e.g., a semiconductor substrate or the like), with a camera 5 arranged in the path of the reflected light rays. When a light-emitting portion 13 is arranged along the optical axis of the lens 11, a bright field illumination takes place. If a knob 29 is turned, the light-emitting portion 13 moves along a ball screw 25, thereby changing the illumination from a bright field illumination to a dark field illumination. When a knob 37 is turned, the light exiting the lens 11 will diverge if the light-emitting portion 13 is moved close to the lens 11, converge if the light-emitting portion 13 is moved far away from the lens 11, and be parallel if the light-emitting portion 13 is positioned at the focal point of the lens 11. By changing the position of the light-emitting portion 13 in this way, it is possible to change the illuminating angle and the illuminating angle distribution, and by adjusting the position of the light-emitting portion 13 in accordance with the optical characteristics of the object 3, it is possible to obtain a high contrast image. It is also possible for these adjustments to be carried out automatically by using an actuator, microcomputer or the like.

U.S. Pat. No. 6,030,089 issued Feb. 29, 2000 to Parker et al., discloses a light distribution system includes an area light emitting portion, a light source for supplying light to an input edge of the light emitting portion for conduction within the light emitting portion and emission therefrom, and a power source for the light source. A holder may be provided for the light emitting portion. The holder may be made of a flexible material to permit the holder to conform to a contoured surface such as the arm or other body part of a person. Also, a flexible band or belt may be provided for personal wear. The light distribution system may include an additional light source which is directional so it can be seen at a greater distance than the area light emitting portion. An information display system controlled by an interactive switch may also be provided for displaying selected information.

U.S. Pat. No. 6,031,343 issued to Recknagel et al., Feb. 29, 2000 Recites lighting system includes at least one light string having a plurality of independently controllable light modules, each emitting light in response to an activation signal uniquely associated with the light module. The lighting system preferably includes a controller coupled to the light strings for generating and transmitting activation signals to the light modules to independently control the lights of the light modules. Each of the light modules may include a multi-color lighting device for emitting light of different colors such that the controller may select colors of the light emitted from each one of the light modules. The lighting system may also include a plurality of address modules each associated with and coupled to one of the light strings and coupled to the controller so that the controller may transmit activation signals to the light modules of a specific light string by transmitting an address to which the associated address module will respond by enabling the light modules of the associated light string to respond to the activation signals transmitted with the address signal from the controller.

Light ropes useful in the present invention are available from sales@nsl-ltg dot com telephone 800–527–2923 or 303–926–1100, facsimile 800–527–4358 303–926–0011 and through http://www.nsl-ltg dot com/lightrope/lrope dot html.

To the extent that the foregoing patents and citations are relevant to the present invention they are herein incorporated by reference.

SUMMARY OF THE INVENTION

The present invention also describes lighting system comprising:

a frame member;

said frame member having a void portion;

an electrical light source emitter for emitting an electrical light;

said void for at least partially receiving said electrical light source emitter;

a transparent or translucent glass member;

said transparent or translucent glass member disposed such that said electrical light source emitter, when emitting light, substantially contacts said transparent or translucent glass member;

an opaque glass member located within said void portion;

provided further that said opaque glass member does not substantially interfere with the transmission of electrical light from said electrical light source emitter through said transparent or translucent glass member.

A further aspect of the lighting system of the present invention comprises:

a frame member;

said frame member having a void portion;

an electrical light source emitter for emitting an electrical light;

said void for at least partially receiving said electrical light source emitter;

at least one transparent or translucent glass member;

an opaque glass member located within said void portion;

said electrical light source emitter, when emitting light, disposed between said transparent or translucent glass member, and said opaque glass member;

provided further that said opaque glass member does not substantially interfere with the transmission of electrical light from said electrical light source emitter through said transparent or translucent glass member.

The present invention also describes a method of lighting comprising:

emitting an electrical light generated by an electrical light source emitter from within a frame member;

said frame member having a void portion;

said frame member further comprising at least one decorative transparent or translucent glass member, and at least one decorative opaque glass member;

wherein the emitted electrical light passes through at least one of send decorative transparent or translucent glass member and reflects from said decorative opaque glass surface.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

With more particular reference to the drawings the following is set forth.

DETAILED DESCRIPTION OF THE INVENTION

Figure 1:
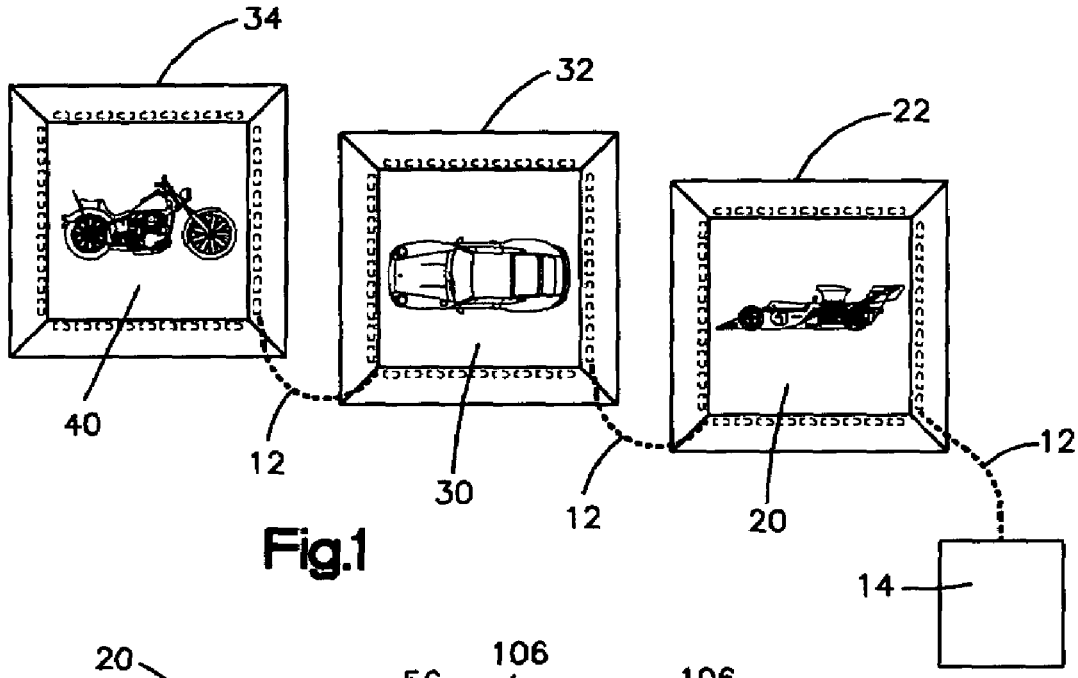
FIG. 1 is a frontal perspective of a finished product embodiment according to the invention.

FIG. 1 shows a series of framed eroded glasses 10. Each of the framed eroded glasses 10 are supplied with an electrical light source emitter such as a light source from a rope light 12 which receives power from a power source 14.

The framed eroded glasses 10 are furthered denominated separately as eroded glass 20, eroded glass 30, and eroded glass 40. The framed eroded glass 20 is retained in a framing unit 22, the framed eroded glass 30 is retained in a framing unit 32 and the framed eroded glass 40 is retained in a framing unit 34.

Figure 2:
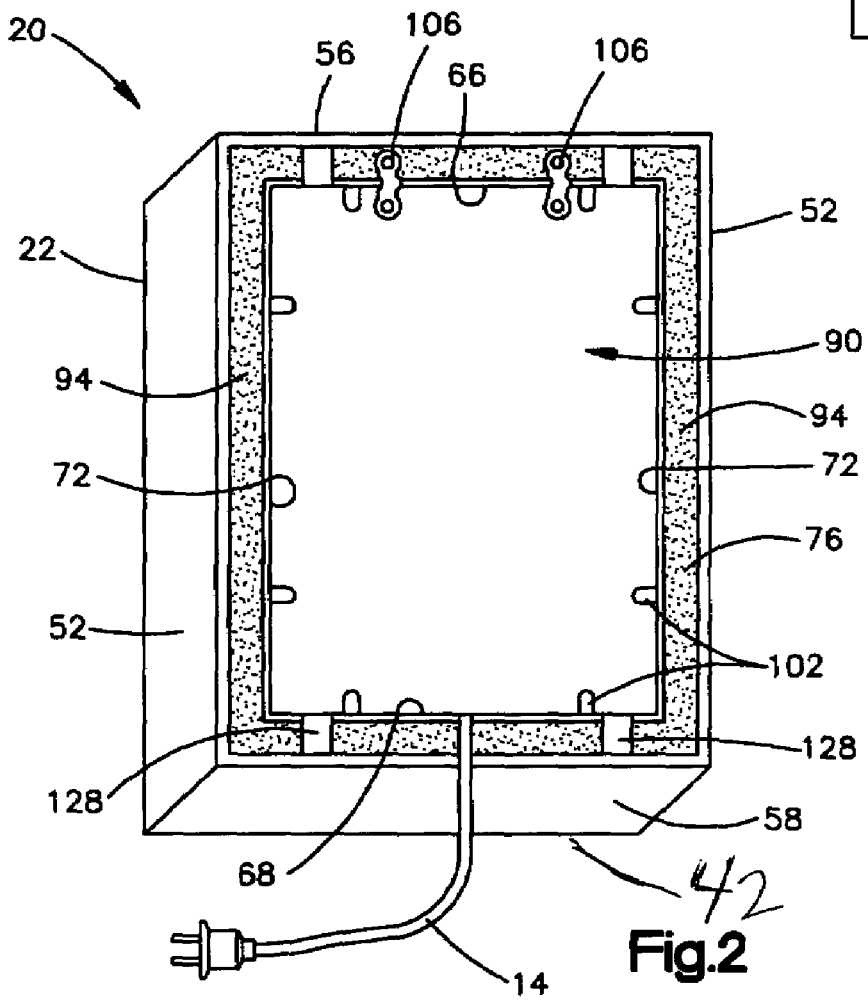
FIG. 2 is the reverse view of a finished product embodiment according to the invention.

As best seen in FIG. 2 is the reverse view of the framing unit 22. The framing unit 22 has two outer side walls 52. The framing unit 22 has outer top wall 56 and an outer bottom wall 58.

The framing unit 22 has an inner top wall 66 and an inner bottom wall 68. The framing unit 22 has two inner side walls 72. A surface 76 extends from the two outer side walls 52 and the outer top wall 56 and the outer bottom wall 58 toward the two inner side walls 72 and the inner top wall 66 and the inner bottom wall 68.

A back plate 90 is secured to the framing unit 22. The back plate 90 may partially protect the various glass components of the present invention. The back plate 90 is conveniently any opaque material. If desired, the opaque material forming the back plate 90 may be a reflective material such as a mirror or metal coated film. The advantage of employing a reflective material is that the light transmitted through the glass is enhanced.

The height dimension of the back plate 90 is less than the corresponding height dimension of the two outer side walls 52. The width dimension of the back plate 90 is less than the corresponding width dimension of the outer top wall 56 and the outer bottom wall 58.

The height dimension of the back plate 90 is greater than the two inner side walls 72. The width dimension of the back plate 90 is greater than the inner top wall 66 and an inner bottom wall 68.

A channel 94 is cut into the inner top wall 66. The channel 94 (also referred to as a void portion) extends to but not through outer top wall 56. The channel 94 is also present in the inner bottom wall 68. The channel 94 extends to but not through the outer bottom wall 58. The channel 94 extends to each inner side walls 72 to but not through the two outer side walls 52.

The formation of the channel 94 adds another step to the operation to form the finished product but permits a tight fit of the various components into the channel 94.

A series of tabs 102 extend along the surface 76. A pair of hangers 106 extends from the outer top wall 56 of the framing unit 22.

Figure 3:
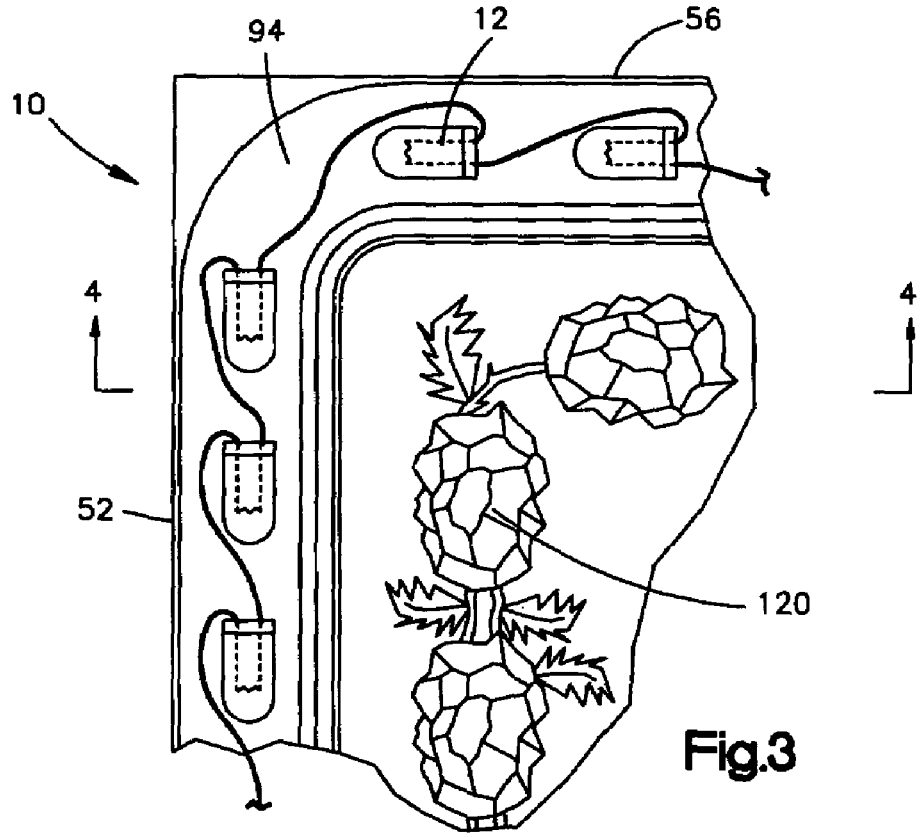
FIG. 3 is a partial sectional view of an embodiment according to the invention.

As best seen in FIG. 3, is a portion of the obverse the framing unit 22 shown in FIG. 2. A piece of engraved glass 120 is fixedly connected into the channel 94. The engraved glass 120 may be of any aesthetically pleasing design.

A string of rope lights 12 shown in the channel 94. The rope lights 12 are available from sales@nsl-ltg dot com. The rope lights 12 may be connected in parallel or series but to avoid the 'Christmas tree problem' parallel lighting is preferred.

Figure 4:
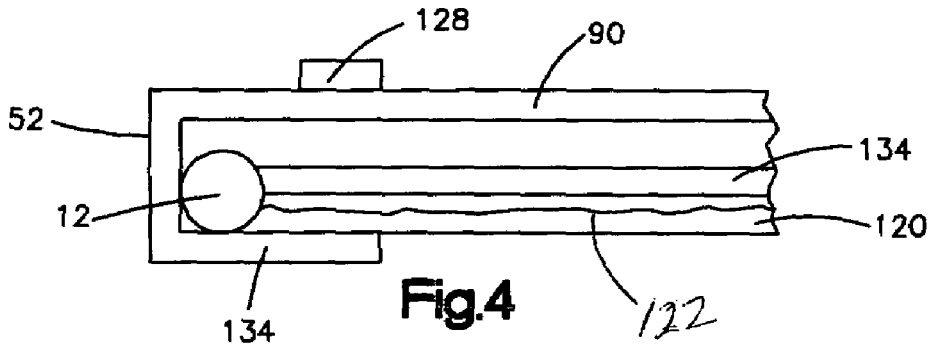
FIG. 4 is a sectional view taken along lines 3—3 of FIG. 3.

As best seen in FIG. 4 is a cross section a portion of the framing unit 22. The frame shown in FIG. 4 is that of a picture frame. A wall relief extension 128 is fixedly connected to the outer side walls 52. Additional wall relief extensions 128 may be added outer top wall 56 and the outer bottom wall 58 and at other portions of the outer side walls 52. The wall relief extension 128 permits the dissipation of heat when the rope light 12 is in use in the framed eroded glasses 10. The piece of engraved glass 120 has an inward facing eroded surface 122.

A frame face 134 may be utilized to retain the engraved glass 120 in the framed eroded glasses 10. While the term eroded glass is utilized throughout the specification and claims it is to be understood that the glass may be cut, drilled, engraved, etched or the like. Typically, the glass will be purchased as a planar workpiece. The planar workpiece will then be engraved to remove a portion of the outer surface of the glass to give an aesthetically pleasing design. The non-planar surfaces generated by the engraving will reflect and refract light differently than the planar workpiece. It is preferred that that glass be clear although translucent glass may be utilized in whole or part. Colored glasses may be employed herein in whole or part as well. While the term glass is utilized herein it is understood that materials such a plexiglass or other plastics may be utilized as long as such materials are transparent or translucent.

Figure 5:
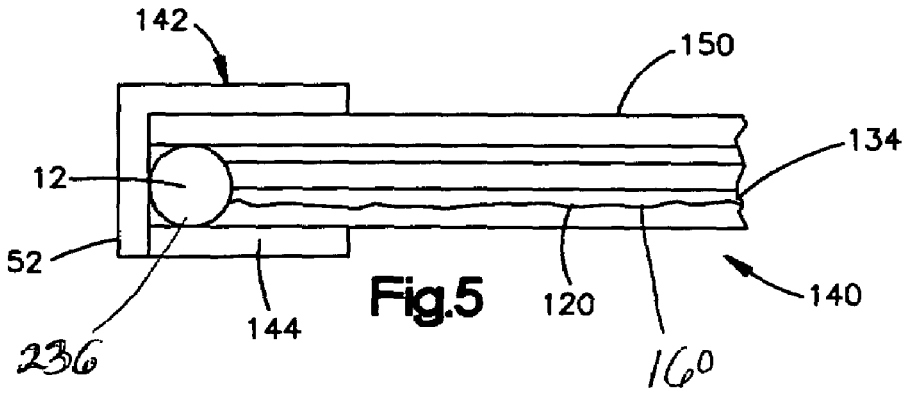
FIG. 5 is a sectional view of an alternative embodiment according to the invention taken along lines 3—3.

FIG. 5 shows an alternative embodiment of the invention based on FIG. 3. The alternative embodiment shown in FIG. 5 demonstrates the usefulness of the present invention in a wall mounted window 140. The two outer side walls 52 extend into a wall 142 of a home to retain the piece of engraved glass 120 in place.

A breathable covering piece 144 is made a part of the framed eroded glasses 10. The breathable covering piece 144 serves the same purpose as the wall relief extension 128 to permit dissipation of heat when the rope light 12 is in use in the framed eroded glasses 10. A layer of protective glass 150 is utilized minimize any risk posed by the use of eroded glass in the window.

The lighting system according to the present invention utilizes the piece of engraved glass 120 to at least partially retain the light rope 12 in the channel 94. The direct contact of the engraved glass 120 to the light rope 12 in the channel 94 is desired as the light from the light rope 12 is more effectively transmitted through engraved glass 120.

In use, and referring to FIG. 4, the light source is activated. As the light source is directly against the eroded glass the light is transmitted through the eroded glass. As the eroding process creates a plurality of surfaces within the glass the light is redirected as it passes through the glass. The eroded portion of the glass surface 120 then reflects and refracts the incident light bringing out the image eroded into the glass.

Figure 6:
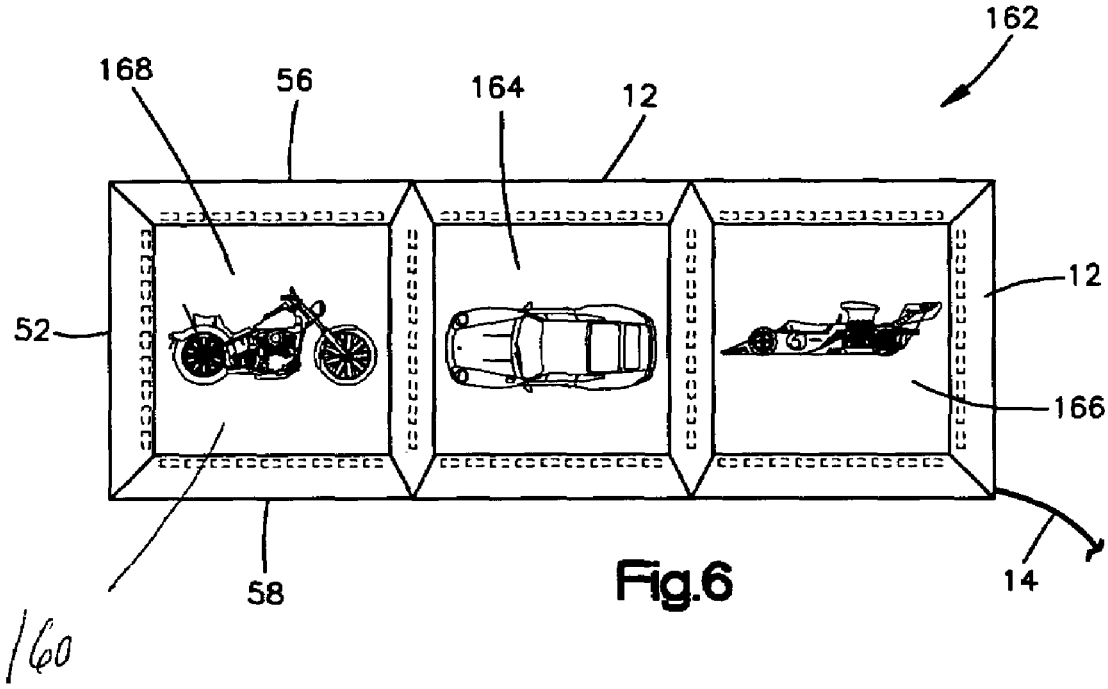
FIG. 6 is a view of plurality of window pains with eroded glass and lighting; and, FIG. 7 is a sectional view similar to FIG. 4 as taken along lines 3—3 of FIG. 3.

As best seen in FIG. 6 is an alternative embodiment of a plurality of pieces of eroded glass 160 mounted in a window 162. The light ropes 12 extend around the window frame such that the inner most piece of eroded glass 164 has a common light rope 12 with the outer piece of eroded glass 166 and the outer piece of eroded glass 168.

Figure 7:
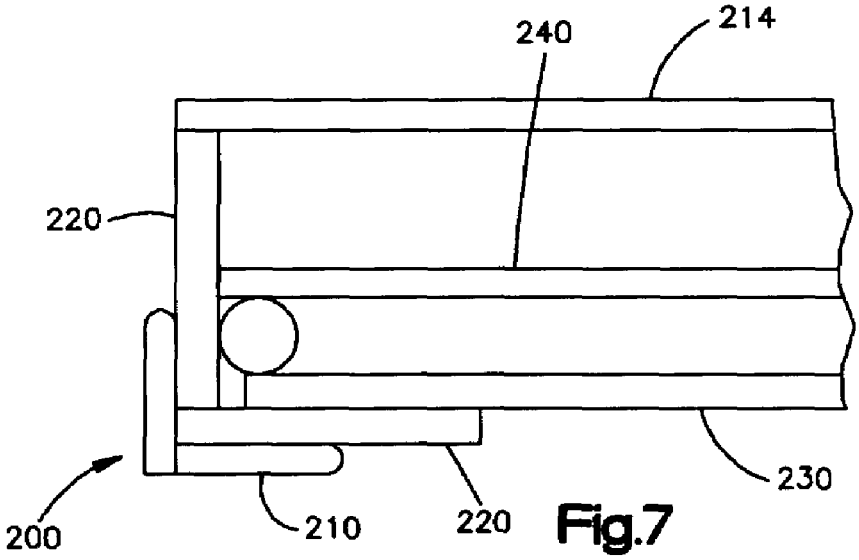

As is best seen in the FIG. 7 is a further embodiment of the present invention. A frame 200 has an outer frame portion 210. The frame 200 has a backing segment 214. The outer frame portion 210 provides a covering to an inner frame portion 220. The frame 200 may be thought of as a box.

The inner frame portion 220 retains a transparent eroded piece of decorative glass 230. A rope light 236 is disposed along the inner frame portion 220 in close proximity to the eroded piece of transparent decorative glass 230. An opaque piece of eroded glass 240 is positioned between the backing segment 214 and the transparent eroded piece of transparent decorative glass 230. The opaque piece of eroded glass 240 is retained by inner frame portion 220.

If desired the eroded piece of transparent decorative glass 230 and the opaque piece of eroded glass 240 may be painted. Any suitable paint which may be permanently adhered to a glass surface may be employed.

A photosensitive switch (not shown) may be engaged to activate the rope light 236 to generate light. The photosensitive switch will, when activated, permit light from the rope light 236 to reflect from the opaque piece of eroded glass 240. The light from the rope light 236 ultimately passes through the eroded piece of transparent decorative glass 230. In this manner, a decorative artwork having three-dimensional properties is obtained.

The eroded piece of transparent decorative glass 230 is visible in well-lighted conditions, such as daylight, even without the light from the rope light 236. As the opaque piece of eroded glass 240 is not particularly visible when in a region of substantial light (daylight or a well lighted room), the decorative art may actually appear as two different works of art depending on whether the light from the rope light 236 is activated.

What is claimed is:

1. A lighting system comprising:

a frame member;

said frame member having a void portion;

an electrical light source emitter for emitting an electrical light provided further that said electrical light source emitter for emitting an electrical light is a rope light;

said void for at least partially receiving said electrical light source emitter;

an eroded transparent or translucent glass member;

said eroded transparent or translucent glass member disposed such that said electrical light source emitter, when emitting light, substantially contacts said eroded transparent or translucent glass member;

a reflective opaque glass backing member located within said void portion;

provided further that said reflective opaque glass backing member does not substantially interfere with the transmission of electrical light from said electrical light source emitter through said eroded transparent or translucent glass member.

2. The lighting system according to claim 1 wherein said electrical light source emitter for emitting an electrical light extends substantially around the void.

3. The lighting system according to claim 1 wherein said eroded transparent or translucent glass member has a lengthwise dimension, a heightwise dimension, a widthwise dimension, said heightwise dimension and said widthwise dimension at least partially defining, a forward surface of said eroded transparent or translucent glass member and a rear surface of said transparent or translucent glass member.

4. The lighting system according to claim 1 wherein said eroded transparent or translucent glass member is transparent.

5. The lighting system according to claim 1 wherein said eroded transparent or translucent glass member is translucent.

6. The lighting system according to claim 1 wherein said void at least partially receives said eroded transparent or translucent glass member.

7. The lighting system according to claim 1 wherein the frame member is a picture frame.

8. The lighting system according to claim 1 wherein the frame member is a window frame.

9. The lighting system according to claim 1 wherein said eroded transparent or translucent glass member at least partially retains said electrical light source emitter within said void.

* * * * *